US011515660B2

(12) United States Patent
Aleman et al.

(10) Patent No.: US 11,515,660 B2
(45) Date of Patent: Nov. 29, 2022

(54) ELECTRICAL CONNECTOR ASSEMBLY WITH RETAINING DEVICE

(71) Applicant: Aptiv Technologies Limited, St. Michael (BB)

(72) Inventors: Jose Alberto Davila Aleman, Saltillo (MX); Matthew L. Penn, Cortland, OH (US)

(73) Assignee: APTIV TECHNOLOGIES LIMITED, St. Michael (BB)

( * ) Notice: Subject to any disclaimer, the term of this patent is extended or adjusted under 35 U.S.C. 154(b) by 222 days.

(21) Appl. No.: 17/015,584

(22) Filed: Sep. 9, 2020

(65) Prior Publication Data

US 2021/0098930 A1 Apr. 1, 2021

Related U.S. Application Data

(60) Provisional application No. 62/908,678, filed on Oct. 1, 2019.

(51) Int. Cl.

*H01R 13/506* (2006.01)
*H01R 13/422* (2006.01)
*H01R 13/508* (2006.01)

(52) U.S. Cl.

CPC ..... *H01R 13/506* (2013.01); *H01R 13/4223* (2013.01); *H01R 13/508* (2013.01); *H01R 2201/26* (2013.01)

(58) Field of Classification Search

CPC ..... H01R 13/4223; H01R 13/426; H01R 13/5025; H01R 13/4362; H01R 13/506;

(Continued)

(56) References Cited

U.S. PATENT DOCUMENTS 4,655,525 A * 4/1987 Hunt, III ..... H01R 13/4367 439/747
4,984,998 A * 1/1991 Duncan ..... H01R 13/6272 439/352

(Continued)

FOREIGN PATENT DOCUMENTS

CN 210779132 U 6/2020
EP 3282521 A2 * 2/2018 ..... H01R 13/4362

(Continued)

OTHER PUBLICATIONS

Extended European Search Report for EP Application No. 20199638.6, dated Dec. 22, 2020, 13 pages.

(Continued)

*Primary Examiner* — Marcus E Harcum
(74) *Attorney, Agent, or Firm* — Billion & Armitage

(57) ABSTRACT

A connector assembly includes a connector body defining a plurality of cavities, extending longitudinally through the connector body. The cavities are configured to receive inner terminal housings configured to hold electrical terminals attached to electrical cables disposed within the cavities. The connector assembly further includes a retaining device slidably attached to the connector body and moveable from a pre-staged position to a staged position. The retaining device allows the inner terminal housings to be inserted or removed from the cavities when in the pre-staged position and inhibits the inner terminal housings from being inserted or removed from the cavities when in the staged position.

17 Claims, 5 Drawing Sheets

(58) Field of Classification Search
CPC ..... H01R 13/508; H01R 2201/26; H01R 13/4367
See application file for complete search history.

(56) References Cited

U.S. PATENT DOCUMENTS

| | | | | |
|---|---|---|---|---|
| 6,811,451 | B2 * | 11/2004 | Mase | H01R 13/4362 439/752 |
| 6,827,609 | B1 * | 12/2004 | Martin | H01R 13/4365 439/595 |
| 7,044,808 | B1 * | 5/2006 | Foltz | H01R 13/4362 439/752 |
| 7,048,581 | B1 | 5/2006 | Wong | |
| 7,195,522 | B2 * | 3/2007 | Okada | H01R 13/4362 439/752 |
| 7,285,011 | B2 | 10/2007 | Hardy et al. | |
| 7,347,745 | B1 * | 3/2008 | Raudenbush | H01R 24/40 439/752 |
| 7,625,251 | B2 * | 12/2009 | Martin | H01R 13/4223 439/752 |
| 7,762,854 | B1 | 7/2010 | Peng | |
| 7,980,894 | B1 | 7/2011 | Hall et al. | |
| 9,680,256 | B1 | 6/2017 | Lane et al. | |
| 9,882,317 | B1 | 1/2018 | Lane | |
| 9,960,550 | B2 * | 5/2018 | Ensley | H01R 24/38 |
| 10,461,457 | B1 * | 10/2019 | Aono | H01R 13/73 |
| 10,892,577 | B1 * | 1/2021 | Probert | H01R 13/424 |
| 2004/0097128 | A1 * | 5/2004 | Wu | H01R 12/57 439/567 |
| 2009/0130902 | A1 | 5/2009 | Hall et al. | |
| 2009/0269963 | A1 * | 10/2009 | Brown | H01R 13/4362 439/357 |
| 2012/0270431 | A1 | 10/2012 | Foltz et al. | |
| 2014/0335720 | A1 * | 11/2014 | Like | H01R 43/26 29/874 |
| 2017/0207578 | A1 * | 7/2017 | Abraham | H01R 13/4362 |
| 2017/0358875 | A1 * | 12/2017 | Farole | H01R 13/4367 |
| 2018/0026408 | A1 * | 1/2018 | Ensley | H01R 24/38 439/578 |
| 2019/0006781 | A1 * | 1/2019 | Hung | H01R 13/4362 |
| 2019/0181580 | A1 * | 6/2019 | Rangi | H01R 13/501 |
| 2020/0295494 | A1 * | 9/2020 | Fernandes | H01R 13/629 |
| 2020/0295496 | A1 * | 9/2020 | Jabrane | H01R 13/639 |
| 2020/0313353 | A1 * | 10/2020 | Kanemura | H01R 13/4223 |

FOREIGN PATENT DOCUMENTS

| | | | | |
|---|---|---|---|---|
| EP | 3410540 | B1 * | 2/2020 | H01R 13/506 |
| JP | 2018014300 | A | 1/2018 | |

OTHER PUBLICATIONS

European Office Action for EP Application No. 20199638.6, dated Mar. 18, 2022, 16 pages.

* cited by examiner

ELECTRICAL CONNECTOR ASSEMBLY WITH RETAINING DEVICE

CROSS-REFERENCE TO RELATED APPLICATION

This application claims benefit of priority to U.S. Provisional Patent Application No. 62/908,678 filed on Oct. 1, 2019, the entire disclosure of which is hereby incorporated by reference.

TECHNICAL FIELD OF THE INVENTION

The invention generally relates to electrical connectors, particularly to an electrical connector assembly suited for use with coaxial cables.

BACKGROUND OF THE INVENTION

Coaxial cable connector assemblies have been used for numerous automotive applications, such as global positioning systems (GPS), infotainment systems, and air bag systems. Coaxial cables typically consist of an outer shield conductor, an inner center conductor, a dielectric, and an insulation jacket. The outer conductor and the inner conductor of the coaxial cable often electrically interface with a mating coaxial cable through socket and plug connectors. Such conventional coaxial cable connectors are known in the art.

To standardize various types of connectors and thereby avoid confusion, certain industry standards have been established. One of these standards is referred to as FAKRA. FAKRA is a German abbreviation for Fachnormenausschuss Kraftfahrzeugindustrie used by the Automotive Standards Committee in the German Institute for Standardization [Deutsches Institut für Normung (DIN)], representing international standardization interests in the automotive field. The FAKRA standard provides a system, based on keying and color coding, for proper connector attachment. Like socket keys can only be connected to like plug keyways in FAKRA connectors. Secure positioning and locking of connector housings is facilitated by way of a FAKRA defined catch on the socket housing and a cooperating latch on the plug housing. The FAKRA standard is also contained in United States Council for Automotive Research (USCAR) USCAR-18 standard.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

According to one embodiment, a connector assembly is provided. The connector assembly includes a connector body defining a plurality of cavities, extending longitudinally through the connector body. The cavities are configured to receive inner terminal housings configured to hold electrical terminals attached to electrical cables disposed within the cavities. The connector assembly also includes a retaining device slidably attached to the connector body and moveable from a pre-staged position to a staged position.

The retaining device allows the inner terminal housings to be inserted or removed from the cavities when in the pre-staged position and inhibits the inner terminal housings from being inserted or removed from the cavities when in the staged position.

In an example embodiment having one or more features of the connector assembly of the previous paragraph, the connector body may include flexible primary locking arms configured to retain the inner terminal housings within the cavities;

In an example embodiment having one or more features of the connector assembly of one or more of the previous paragraphs, the connector body may further define a pair of upper grooves and a pair of lower grooves in opposite outer surfaces of the connector body.

In an example embodiment having one or more features of the connector assembly of one or more of the previous paragraphs, the retaining device, may have a generally planar base portion and a pair of complaint cantilevered arms having fixed ends attached to the base and extending from two opposed distal edges of the base.

In an example embodiment having one or more features of the connector assembly of one or more of the previous paragraphs, free ends of the arms may each define latch features are configured to engage the lower grooves when the retaining device is in the pre-staged position 30, thus securing the retaining device to the connector body in the pre-staged position and further configured to engage the upper grooves when the retainer is in the staged position 32, thus securing the retaining device to the connector body in the staged position.

In an example embodiment having one or more features of the connector assembly of one or more of the previous paragraphs, the retaining device may further include a terminal retaining wall that extends perpendicularly from an edge of the base and is arranged generally perpendicular to the cantilevered arms and wherein the retaining wall is configured to partially block rear openings of the cavities.

In an example embodiment having one or more features of the connector assembly of one or more of the previous paragraphs, the retaining wall may be attached to side walls that are generally parallel to the cantilevered arms.

In an example embodiment having one or more features of the connector assembly of one or more of the previous paragraphs, the inner terminal housings may define a generally cylindrical shape and wherein an upper edge of the terminal retaining wall defines concave cutouts that engage circumferential grooves in the inner terminal housings.

In an example embodiment having one or more features of the connector assembly of one or more of the previous paragraphs, radii of the concave cutouts may be sized and shaped to correspond with the shape of the circumferential grooves in the inner terminal housings.

In an example embodiment having one or more features of the connector assembly of one or more of the previous paragraphs, the concave cutouts may define a mirrored J shape.

In an example embodiment having one or more features of the connector assembly of one or more of the previous paragraphs, the side walls and the primary locking arms may be arranged such that movement of the retainer from the pre-staged position to the staged position is inhibited when the inner terminal housings are not properly seated within the cavities.

In an example embodiment having one or more features of the connector assembly of one or more of the previous paragraphs, the connector body, the retaining device, and the inner terminal housings may each be formed of a dielectric polymer material.

In an example embodiment having one or more features of the connector assembly of one or more of the previous paragraphs, the connector assembly may conform to United States Council for Automotive Research USCAR-18 standards.

In an example embodiment having one or more features of the connector assembly of one or more of the previous paragraphs, the cavities and the inner terminal housings may conform to United States Council for Automotive Research USCAR-18 standards.

In an example embodiment having one or more features of the connector assembly of one or more of the previous paragraphs, the inner terminal housing may conform to FAKRA specifications.

According to another embodiment, a connector assembly is provided. The connector assembly includes a connector body defining a plurality of terminal cavities, extending longitudinally through the connector body. The cavities are configured to receive inner terminal housings configured to hold electrical terminals attached to electrical cables disposed within the cavities. The connector assembly also includes means for retaining inner terminal housings within the cavities, the means being moveable from a pre-staged position to a staged position which allows the inner terminal housings to be inserted or removed from the cavities to a staged position which inhibits the inner terminal housings from being inserted or removed from the cavities.

According to yet another embodiment, a method of assembling a connector is provided. The method includes inserting electrical terminals connected to electrical cables within inner terminal housings, inserting the inner terminal housings within cavities defined by a connector body having a retaining device slidably attached to the connector body while the a retaining device is in a pre-staged position which allows the inner terminal housings to be inserted in the cavities. The retaining device is configured to partially block rear openings of the cavities. The method further includes slidably moving the retaining device from the pre-staged position to a staged position which inhibits the inner terminal housings from being removed from the cavities from a pre-staged position which allows the inner terminal housings to be inserted in the cavities.

In an example embodiment having one or more features of the method of the previous paragraph, the method may further include the steps of slidably moving the retaining device from the staged position to the pre-staged position and removing the inner terminal housings from the cavities.

In an example embodiment having one or more features of the method of one or more of the previous paragraphs, movement of the retainer from the pre-staged position to the staged position may be inhibited when the inner terminal housings are not properly seated within the cavities.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Figure 1:
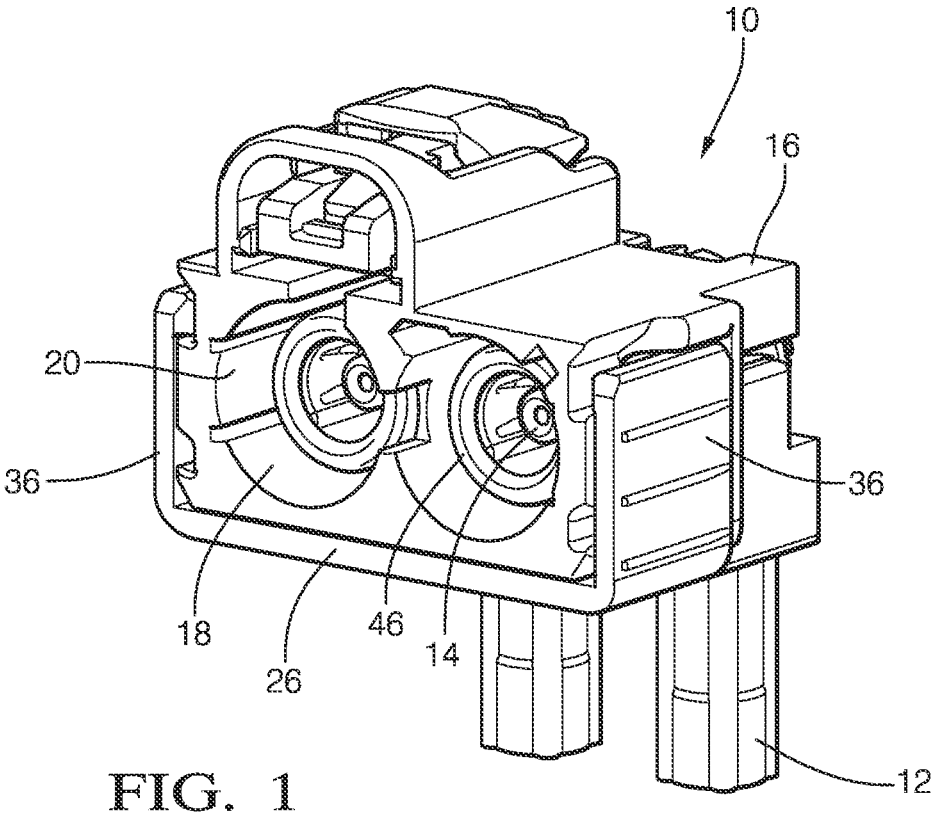
FIG. 1 is a front perspective view of an electrical connector assembly in accordance with an embodiment of the invention.
Figure 2:
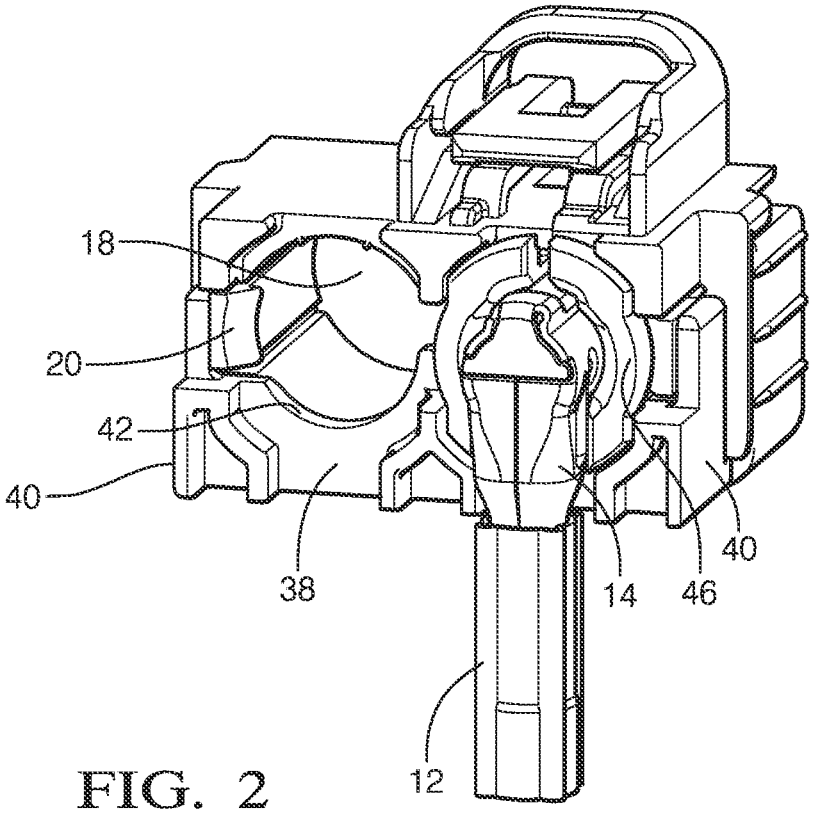
FIG. 2 is a rear perspective view of the electrical connector assembly of FIG. 1 in accordance with an embodiment of the invention.
Figure 3:
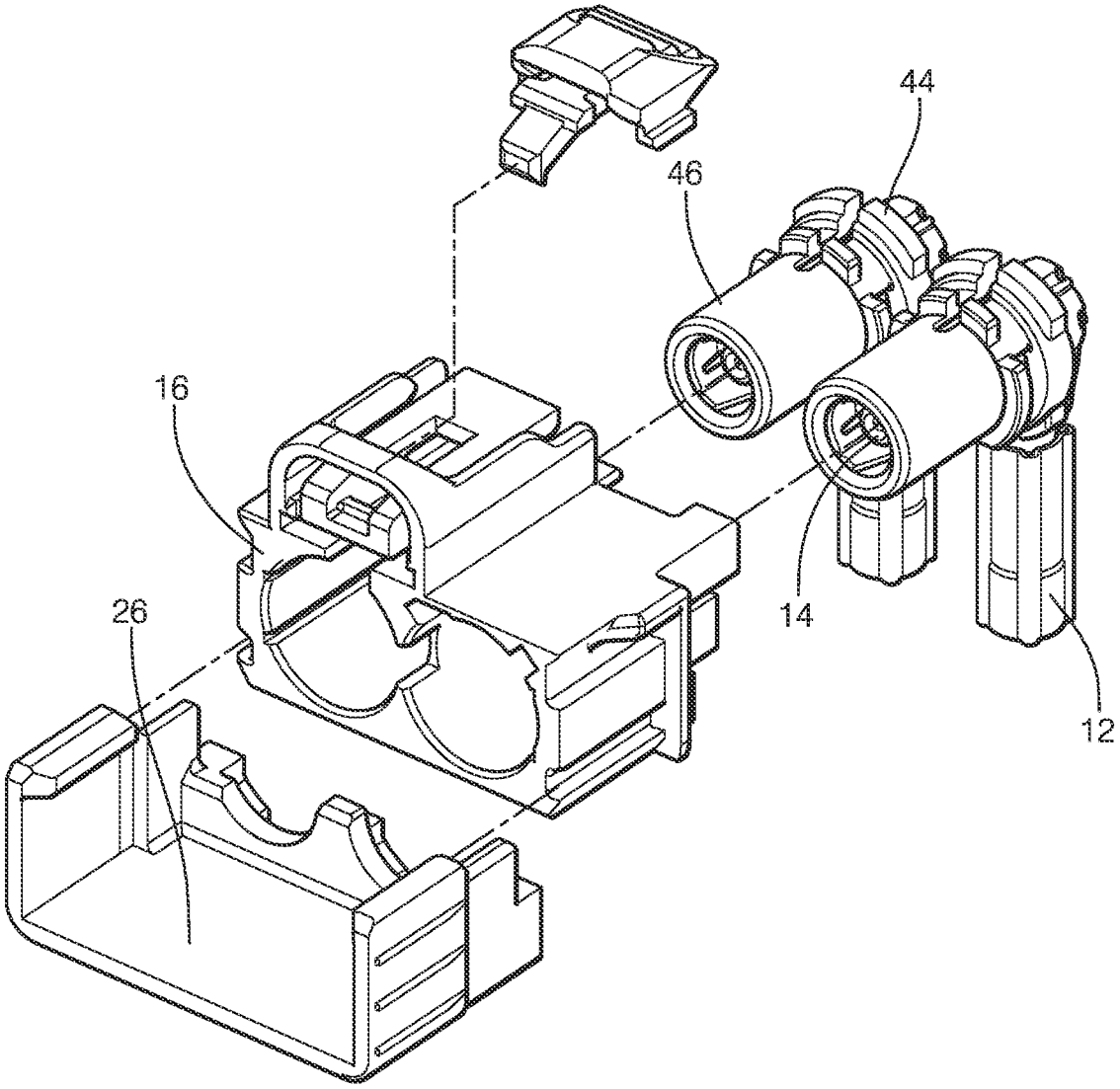
FIG. 3 is an exploded view of the electrical connector assembly of FIG. 1 in accordance with an embodiment of the invention.
Figure 4:
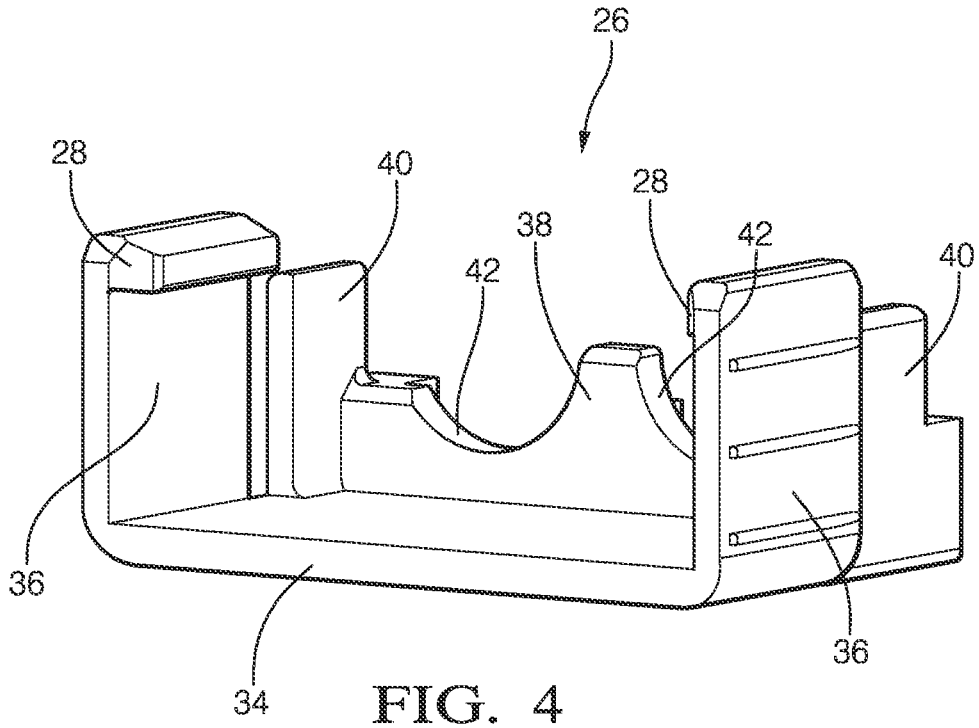
FIG. 4 is an isolated perspective view of a moveable member that provides a primary lock reinforcement and secondary terminal lock function that is part of the electrical connector assembly of FIG. 1 in accordance with an embodiment of the invention.
Figure 5:
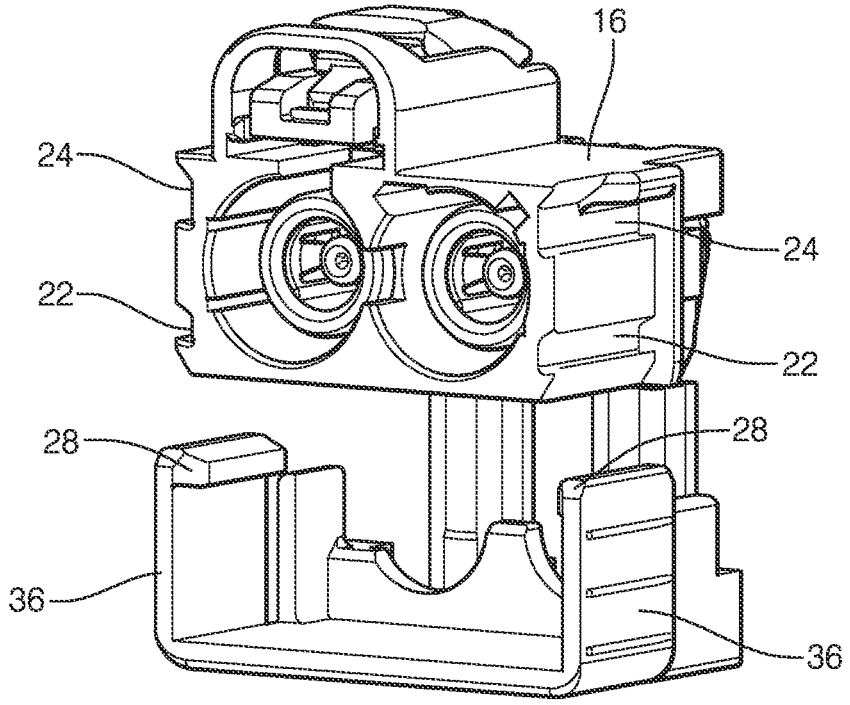
FIG. 5 is a pre-assembly view of the electrical connector assembly of FIG. 1 in accordance with an embodiment of the invention.

Reference will now be made in detail to embodiments, examples of which are illustrated in the accompanying drawings. In the following detailed description, numerous specific details are set forth to provide a thorough understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

FIGS. 1 through 7B illustrate an example of a connector assembly 10, hereinafter referred to as the connector 10. In this illustrated example, the connector 10 is configured to interconnect wire cables 12 having terminals 14 attached to ends of the cables 12. The connector 10 includes a connector body 16 that defines several cavities 18 extending longitudinally through the connector body 16. The cavities 18 are configured to receive the terminals 14. The connector body 16 also includes flexible primary locking arms 20 that are configured to retain the terminals 14 within the cavities 18. These primary locking arms 20 flex outwardly as the terminals 14 are inserted into the cavities 18 and then return to their original position once the terminals 14 are fully seated within the cavities 18. The connector body 16 further defines a pair of first grooves, hereinafter referred to as the lower grooves 22 and a pair of second grooves, hereinafter referred to as the upper grooves 24 in two opposite outer surfaces of the connector body 16. The connector body 16 is formed of a dielectric polymer material, such as polyamide (NYLON), polybutylene terephthalate (PBT), or acrylonitrile butadiene styrene (ABS).

The connector 10 also includes a retaining device, hereinafter referred to as the retainer 26. The retainer 26 is also formed of a dielectric polymer material, such as NYLON, PBT, or ABS. The retainer 26 is attached to the connector body 16 and is moveable from a pre-staged position 30 shown in FIGS. 6A and 6B which allows the terminals 14 to be inserted or removed from the cavities 18 to a staged position 32 shown in FIGS. 7A and 7B which inhibits the terminals 14 from being inserted or removed from the cavities 18. The retainer 26 has a generally planar base portion, hereinafter referred to as the base 34.

Pairs of complaint cantilevered arms 36 have fixed ends that are attached to the base 34 and extend upwardly from two opposed distal edges of the base 34. Free ends of the arms each define latch features 28 that are configured to engage the lower grooves 22 when the retainer 26 is in the pre-staged position 30, thus securing the retainer 26 to the connector body 16 in the pre-staged position 30. The latch features 28 that are also configured to engage the upper grooves 24 when the retainer 26 is in the staged position 32, thus securing the retainer 26 to the connector body 16 in the staged position 32.

The retainer 26 further includes a retaining wall 38 that extends perpendicularly upwardly from a rear edge the base 34 and is arranged generally perpendicular to the cantilevered arms 36. The retaining wall 38 is configured to partially block rear openings of the cavities 18, thereby forming a secondary terminal locking feature by inhibiting removal of the terminals 14 from the cavities 18. The retaining wall 38 is attached to side walls 40 that are generally parallel to the cantilevered arms 36. These side walls 40 cooperate with the retaining wall 38 to provide the retaining wall 38 with enhanced resistance to removal of the terminals 14 when the retainer 26 in the staged position 32.

In the illustrated example, the upper edge of the terminal retaining wall 38 defines concave cutouts 42 that engage circumferential grooves 44 in an inner terminal housing 46 conforming to FAKRA specifications in which the terminal is disposed. A radius of the concave cutouts 42 is sized and shaped to correspond with the shape of the circumferential grooves 44 of the inner terminal housing 46.

Figure 6A:
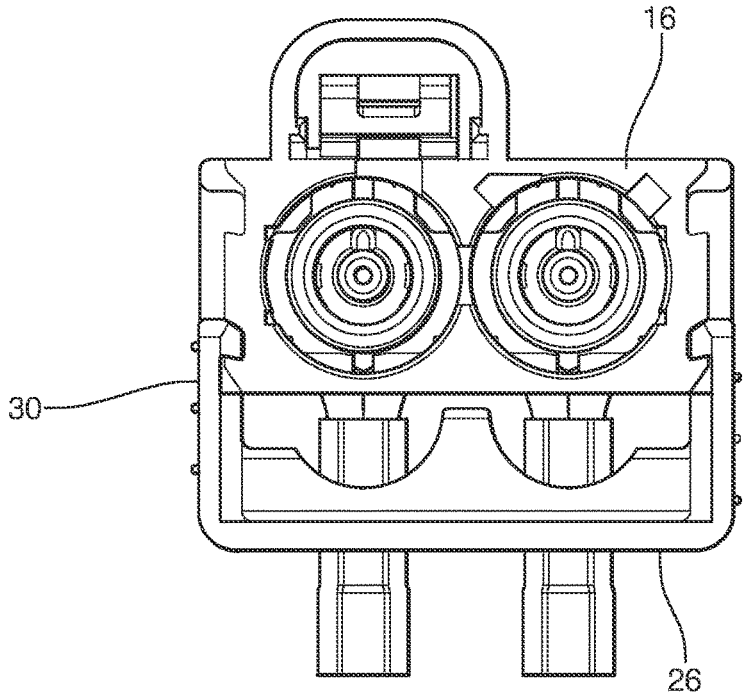
FIG. 6A is a front view of the electrical connector assembly of FIG. 1 with the moveable member in a pre-staged position in accordance with an embodiment of the invention.
Figure 6B:
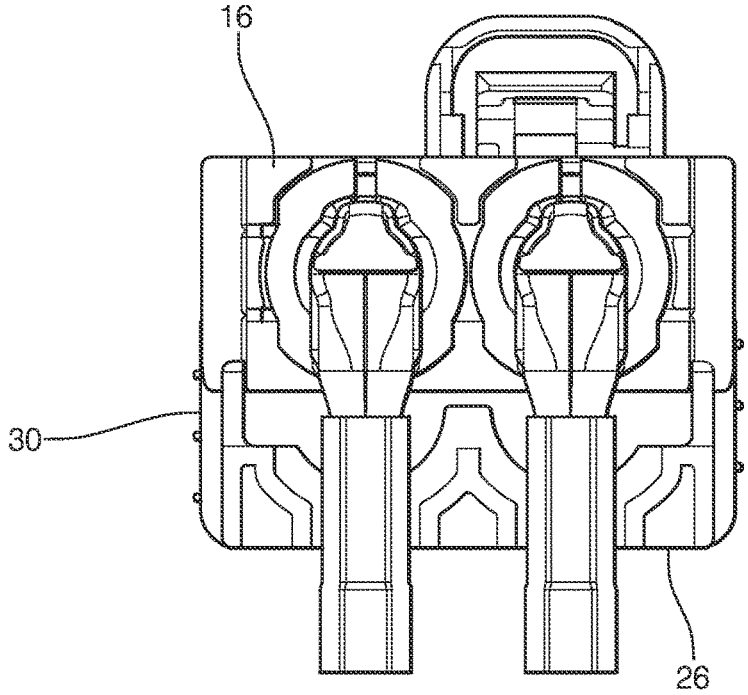
FIG. 6B is a rear view of the electrical connector assembly of FIG. 1 with the moveable member in the pre-staged position in accordance with an embodiment of the invention.

FIGS. 6A and 6B illustrate the connector 10 with the retainer 26 in the pre-staged position 30. In the pre-staged position 30, the latch features 28 of the cantilevered arms 36 are engaged with the lower grooves 22 and the retaining wall 38 is not blocking the cavities 18. In the pre-staged position 30, the primary locking arms 20 can flex and terminals 14 may be inserted through the rear openings of the cavities 18.

Figure 7A:
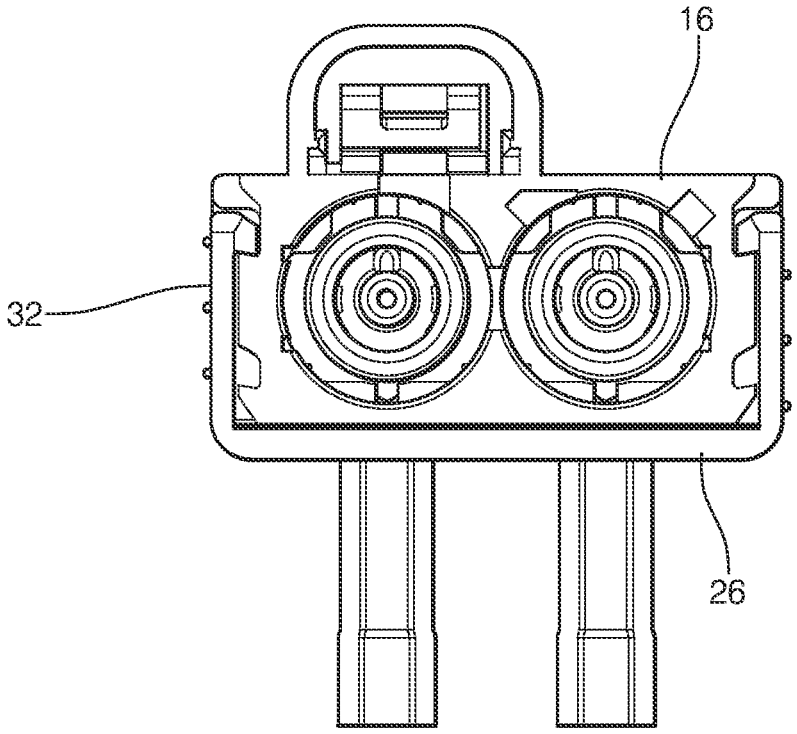
FIG. 7A is a front view of the electrical connector assembly of FIG. 1 with the moveable member in the staged position in accordance with an embodiment of the invention.
Figure 7B:
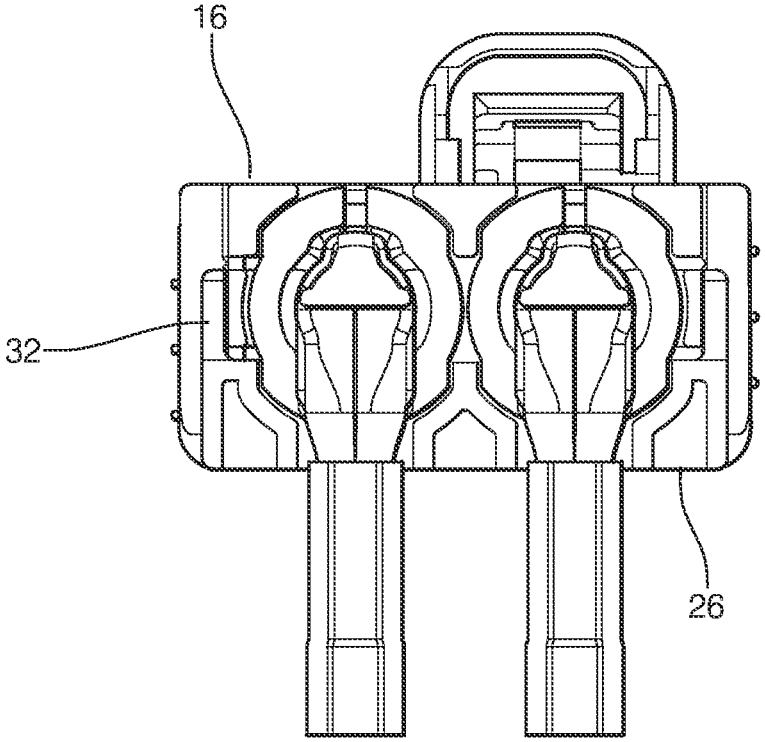
FIG. 7B is a rear view of the electrical connector assembly of FIG. 1 with the moveable member in the staged position in accordance with an embodiment of the invention.

FIGS. 7A and 7B illustrate the connector 10 with the retainer 26 in the staged position 32. In the staged position 32, the latch features 28 of the cantilevered arms 36 are engaged with the upper grooves 24 and the side walls 40 cover the primary locking arms 20 and inhibit flexing of the primary locking arms 20. The retaining wall 38 also partially blocks the rear openings of the cavities 18. In the staged position 32, removal of the terminals 14 from the cavities 18 is inhibited.

The side walls 40 and the primary locking arms 20 are arranged such that movement of the retainer 26 from the pre-staged position 30 to the staged position 32 is inhibited if the terminal is not properly seated within the terminal cavity. This feature provides a benefit of alerting an assembly operator that one or more of the terminals are improperly installed within the cavities 18 of the connector body 16.

While the illustrated example of FIGS. 1-7B has terminals 14 that are generally arranged in at right angle to the cables 12, alternative embodiments of the connector may be envisioned in which the terminals are arranged generally parallel or in line with the cables.

While the illustrated embodiment is directed to an electrical connector assembly, other embodiments may be envisioned that are adapted for use with other types of connector assemblies for fiber optic cables, pneumatic tubes, hydraulic tubes, or a hybrid connector assembly including two or more of the items listed above.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the invention without departing from its scope. Dimensions, types of materials, orientations of the various components, and the number and positions of the various components described herein are intended to define parameters of certain embodiments and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

As used herein, 'one or more' includes a function being performed by one element, a function being performed by more than one element, e.g., in a distributed fashion, several functions being performed by one element, several functions being performed by several elements, or any combination of the above.

It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact.

The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context.

Additionally, while terms of ordinance or orientation may be used herein these elements should not be limited by these terms. All terms of ordinance or orientation, unless stated otherwise, are used for purposes distinguishing one element from another, and do not denote any particular order, order of operations, direction or orientation unless stated otherwise.

We claim:

1. A connector assembly, comprising:

a connector body defining a plurality of cavities, extending longitudinally through the connector body;

inner terminal housings disposed within the cavities, the inner terminal housings configured to hold electrical terminals attached to electrical cables, wherein the connector body includes flexible primary locking arms configured to retain the inner terminal housings within the cavities; and a retaining device slidably attached to the connector body and moveable from a pre-staged position to a staged position, wherein the retaining device allows the inner terminal housings to be inserted or removed from the cavities when in the pre-staged position and inhibits the inner terminal housings from being removed from the cavities when in the staged position by partially blocking rear openings of the cavities and inhibiting flexing of the primary locking arms.

2. The connector assembly according to claim 1, wherein the connector body further defines a pair of upper grooves and a pair of lower grooves in opposite outer surfaces of the connector body.

3. The connector assembly according to claim 2, wherein the retaining device has a generally planar base portion and a pair of compliant cantilevered arms having fixed ends attached to the base and extending from two opposed distal edges of the base.

4. The connector assembly according to claim 3, wherein free ends of the arms each define latch features that are configured to engage the lower grooves when the retaining device is in the pre-staged position, thus securing the retaining device to the connector body in the pre-staged position and further configured to engage the upper grooves when the retaining device is in the staged position, thus securing the retaining device to the connector body in the staged position.

5. The connector assembly according to claim 4, wherein the retaining device further includes a terminal retaining wall that extends perpendicularly from an edge of the base and is arranged generally perpendicular to the cantilevered arms and wherein the retaining wall is configured to partially block the rear openings of the cavities.

6. The connector assembly according to claim 5, wherein the retaining wall is attached to side walls that are generally parallel to the cantilevered arms.

7. The connector assembly according to claim 6, wherein the inner terminal housings define a generally cylindrical shape and wherein an upper edge of the terminal retaining wall defines concave cutouts that engage circumferential grooves in the inner terminal housings.

8. The connector assembly according to claim 7, wherein radii of the concave cutouts are sized and shaped to correspond with the shape of the circumferential grooves in the inner terminal housings.

9. The connector assembly according to claim 7, wherein the concave cutouts define a mirrored J shape.

10. The connector assembly according to claim 6, wherein the side walls and the primary locking arms are arranged such that movement of the retainer from the pre-staged position to the staged position is inhibited when the inner terminal housings are not properly seated within the cavities.

11. The connector assembly according to claim 1, wherein the connector body, the retaining device, and the inner terminal housings are each formed of a dielectric polymer material.

12. A connector assembly, comprising:

a connector body defining a plurality of terminal cavities, extending longitudinally through the connector body, wherein the cavities are configured to receive inner terminal housings disposed within the cavities, the inner terminal housings configured to hold electrical terminals attached to electrical cables, wherein the connector body includes flexible primary locking arms configured to retain the inner terminal housings within the cavities; and means for retaining inner terminal housings within the cavities, the means being moveable from a pre-staged position which allows the inner terminal housings to be inserted or removed from the cavities to a staged position which inhibits the inner terminal housings from being removed from the cavities when in the staged position by partially blocking rear openings of the cavities and inhibiting flexing of the primary locking arms.

13. A method of assembling a connector, comprising:

inserting electrical terminals connected to electrical cables within inner terminal housings;

inserting the inner terminal housings within cavities defined by a connector body having a retaining device slidably attached to the connector body while the retaining device is in a pre-staged position which allows the inner terminal housings to be inserted in the cavities, wherein the connector body includes flexible primary locking arms configured to retain the inner terminal housings within the cavities; and slidably moving the retaining device from the pre-staged position to a staged position which inhibits the inner terminal housings from being removed from the cavities, wherein the retaining device includes a terminal retaining wall configured to partially block rear openings of the cavities and side walls configured to inhibit flexing of the primary locking arms when in the staged position.

14. The method according to claim 13, further comprising:

slidably moving the retaining device from the staged position to the pre-staged position; and removing the inner terminal housings from the cavities.

15. The method according to claim 13, wherein movement of the retaining device from the pre-staged position to the staged position is inhibited when the inner terminal housings are not properly seated within the cavities.

16. The connector assembly according to claim 1, wherein the retaining device inhibits the inner terminal housings from being inserted in the cavities when in the staged position by partially blocking the rear openings of the cavities.

17. The connector assembly according to claim 6, wherein the side walls cover the primary locking arms and inhibit flexing of the primary locking arms when the retaining device is in the staged position.

* * * * *